US005237929A

United States Patent [19]

Ekholm

[11] Patent Number: 5,237,929

[45] Date of Patent: Aug. 24, 1993

[54] PROJECTILE-FORMING CHARGE

[75] Inventor: Olof Ekholm, Karlskoga, Sweden

[73] Assignee: Bofors AB, Karlskoga, Sweden

[21] Appl. No.: 906,359

[22] Filed: Jun. 30, 1992

[30] Foreign Application Priority Data

Jul. 1, 1991 [SE] Sweden ..... 9102021

[51] Int. Cl.[5] ..... F42B 1/028; F42B 12/10

[52] U.S. Cl. ..... 102/476; 102/306; 102/307; 102/309; 102/501

[58] Field of Search ..... 102/476, 475, 306, 307, 102/309, 501

[56] References Cited

U.S. PATENT DOCUMENTS

| | | | |
|---|---|---|---|
| 4,622,901 | 11/1986 | Witt et al. | 102/476 |
| 4,714,019 | 12/1987 | Lips et al. | 102/307 |
| 4,776,272 | 10/1988 | Lindstadt et al. | 102/309 |
| 4,776,278 | 10/1988 | Scholles et al. | 102/307 |
| 4,976,203 | 12/1990 | Weisshaupt et al. | 102/476 |
| 4,979,443 | 12/1990 | Rittel et al. | 102/501 |
| 4,982,667 | 1/1991 | Weimann | 102/306 |
| 5,033,387 | 7/1991 | Lips | 102/476 |

FOREIGN PATENT DOCUMENTS

| | | |
|---|---|---|
| 0362564 | 4/1990 | European Pat. Off. . |
| 3329969 | 6/1990 | Fed. Rep. of Germany . |

*Primary Examiner*—David H. Brown

*Attorney, Agent, or Firm*—Pollock, Vande Sande & Priddy

[57] ABSTRACT

The present invention relates to a projectile-forming explosive charge (1) of the type which includes a forward concave insert (2) disposed in the envisaged effect direction of the charge and being reformed on detonation of the charge into a cohesive projectile (4). According to the invention, this projectile (4) is given advantageous ballistic configuration with the aid of a specifically designed annular portion (3) which is also utilized for retaining the insert (2) in that sleeve (8) which surrounds the explosive charge (9) on the other sides.

2 Claims, 1 Drawing Sheet

PROJECTILE-FORMING CHARGE

TECHNICAL FIELD

The present invention relates to a new and improved type of so-called projectile-forming hollow charges.

BACKGROUND ART

Hollow charges are understood to be such charges that consist of an explosive charge enclosed in a container which, forwardly in the envisaged effective direction of flight, is terminated by a conically or spherically segment-shaped metal insert of limited thickness and which, with its convex side, is turned to face towards the explosive, and with its concave side turned to face towards the intended target and which thus gives rise to a hollowing out of the charge proper forwardly in the effective direction of flight (hence the German designation Hohlladung).

Depending on the shape of this metal insert, the charge, on being initiated from the opposite side to the side of the insert and mostly from the metal in the insert will either form a jet of particles which is flung at great speed towards the target or, alternatively, the available metal will be more or less held together as a cohesive body, a so-called "slug", which is flung in a direction towards the target at very great speed. The jet-forming hollow charges will have the best effect and penetration of, for example, an armored target if they are detonated at a distance from the target which has been thoroughly tested and proven in advance. When jet-forming hollow charges are employed in projectiles of one kind or another, they are therefore provided with means which trigger the charge at exactly the right distance from the target. The projectile-forming hollow charges can, on the other hand, be triggered at more undetermined distances from the target in order to penetrate the target with their projectile or slug through the combination of mass and high velocity. Such long-distance effective, projectile-forming hollow charges are therefore often employed in booby traps and that type of so-called intelligent ammunition which is homed in over a given area which it then scans with a built-in target scanner in order, when located above the target, to fire a projectile-forming hollow charge in a direction towards the target. Both in this case and in the case of remote-fired mines, the distance to the target is indefinite and rather varying. Despite the high original velocity of the slug, it is desirable to be able to impart thereto the best possible ballistic properties, since the retarding effect of air would otherwise considerably reduce penetration into the target. If no particular measures are adopted, the rear portion of the slug will assume, for instance, a more or less manifest disc shape which significantly deteriorates the ballistic properties of the slug.

The German patent specification 33 29 969 describes the problem inherent in the configuration of the slug, at the same time as certain measures are proposed for realizing a slug which possesses good ballistic properties.

According to this patent specification, it is, namely, possible to influence the design of the slug in the desired direction, i.e. to impart to the slug a ballistically favourable shape, if one of the components included in the charge (by which is meant the explosive charge, the metal insert or the container enclosing the charge) is provided with at least three inhomogeneities symmetrically disposed in relation to the centre axis of the charge. The reason for this is that the shock wave from the detonating explosive charge will then impinge upon the insert, either with different force or at a different time, at symmetrically disposed, clearly defined points. This causes a reshaping of the slug at the relevant places. The inhomogeneity may reportedly lie in the insert, in the explosive filler, in the encapsulation of the charge or in the ignition system.

If the inhomogeneities are disposed at the insert, they can, according to the above-mentioned patent specification, consist of radially disposed machinings of the insert, for example in the form of a corrugation along its outer edge, but such machinings of the insert as radially disposed, jet-shaped continuous inhomogeneities of different densities and/or wall thicknesses are also mentioned. These are described as giving rise to fold lines along which the rear portion of the slug formed on detonation of the charge is reshaped so as approximately to be imparted the form of a number of steering fins.

The patent specification also discloses that it is fully sufficient if the inhomogeneities are of the order of magnitude of 0.1 mm.

According to European patent 0 244 507, it is possible to achieve a corresponding result if the charge is provided with inhomogeneities in the form of portions or sectors with force transmission of different intensity between the outer periphery of the insert and that sleeve which surrounds the explosive charge on other sides.

In order to achieve this object, spot crimpings or alternatively spot welding or spot gluing have been proposed in the above patent. However, all of these types of joints are difficult to render sufficiently exactly defined in order to provide the carefully pre-planned folding together of the rear portion of the slug.

The present invention now relates to a novel, simpler and more exact method of realizing portions along the outer edge of the insert with contact of varying strengths between the outer edge of the insert and the sleeve enclosing the explosive substance. According to the present invention, this is achieved in that the insert forming the forward cavity of the charge is secured into the sleeve surrounding the explosive of the charge by means of an annular portion which is disposed ahead of the insert in the effective direction of the charge and secured along the inner edge of the sleeve, the annular portion being provided with a number of symmetrically disposed grooves extending in towards the sleeve wall and forming therebetween lugs extending radially towards the center of the charge and, during formation of the slug under the action of the detonating explosive charge, function as crease formation stops. Thus, these lugs may be of a size, shape and material thickness which give the rear portion of the slug or its flaretail a number of steering fins created by fold formations which give an aerodynamically more stable projectile. The dimensions and shape of the lugs and the thickness of the annular portion must be tested for each individual case, at least until further notice.

Compared with the prior art technology, the present invention primarily offers a simpler and better defined method of realizing a per se previously known effect.

The same or similar result could thus probably be achieved with symmetrically disposed radial jet-shaped machinings in the upper surface of the insert.

The method and the apparatus according to the present invention and will now be described further in connection with the accompanying drawings.

DESCRIPTION OF PREFERRED EMBODIMENT

Figure 1:
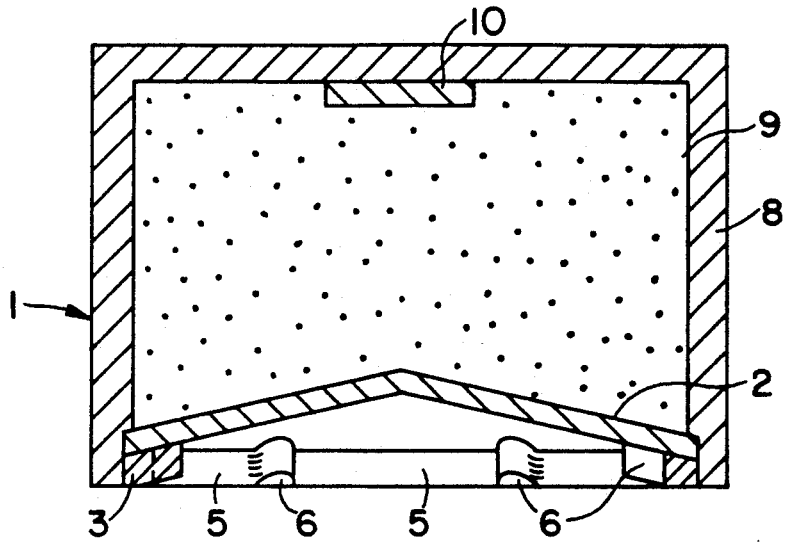
FIG. 1 is a sectioned side elevation of the charge according to the present invention.
Figure 2:
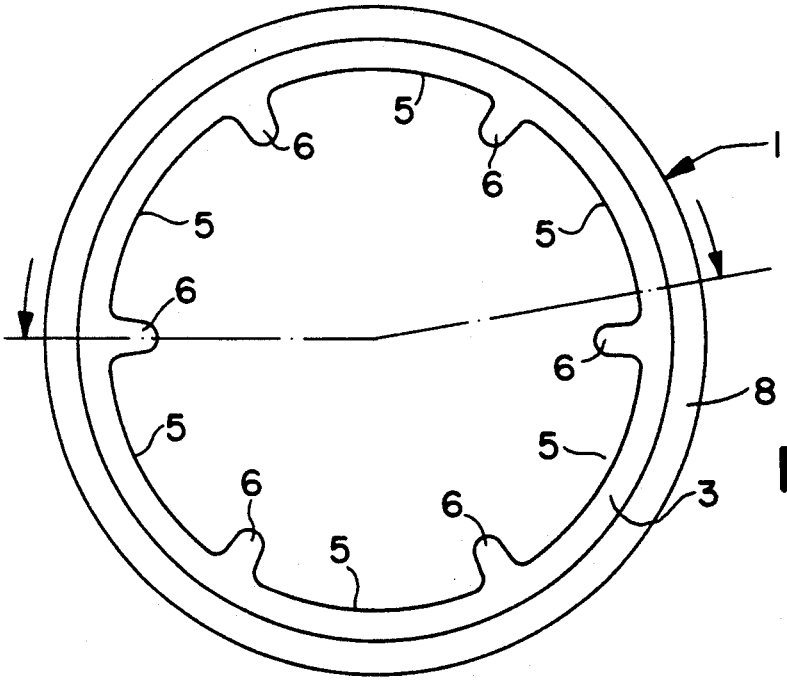
FIG. 2 is a plan view of the same charge.
Figure 3:
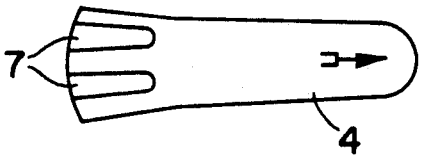
FIG. 3 is a lateral projection showing the fundamental design of the projectile or slug formed on detonation of the charge.
Figure 4:
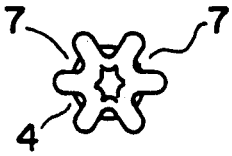
FIG. 4 shows the same projectile or slug in end elevation, seen from behind in its direction of movement.

The projectile-forming charge 1 according to FIGS. 1 and 2 displays in its turn an insert 2 which is retained by an annular portion 3 in that sleeve 8 which, on other sides, surrounds the explosive filling 9 of the charge and an initiation or detonation device 10, the annular portion 3 having, in accordance with the invention, been provided with a number of groove 5 of equal or unequal depth, between which there remain a number of lugs or projections 6 extending in towards the centre of the charge. These projections form a pattern which influences the insert 2 during the reforming cycle when the insert is affected by the detonating explosive. The lugs or projections 6 may, as has already been mentioned, be made with different shapes and material thicknesses. This provides the desired fold formation, as exemplified in FIGS. 3 and 4. As is apparent from these Figures, the fold formation 7 is disposed at the rear portion of the formed projectile or slug 4 whose direction of movement has been marked by an arrow. The fold formation hence provides the projectile and slug with more or less manifest steering fins. This gives an aerodynamically clearly more stable projectile.

What we claim and desire to secure by Letters Patent is:

1. A projectile-forming explosive charge which includes a forward-facing concave metal insert, said insert imparting to an explosive filler of the charge a similarly-shaped forward-facing concave cavity, a sleeve surrounding said explosive filler, and initiation means disposed in a rear portion of said sleeve for detonating the explosive charge, wherein said concave insert is secured in said sleeve by an annular member which is disposed forwardly of said insert, said annular member having an inner surface comprising a plurality of symmetrically disposed concave grooves, spaced apart by inwardly radially-projecting lugs for forming grooves in a projectile formed from said insert by detonation of said explosive charge, said concave grooves comprising a substantially greater part of the inner surface of said annular member than the lugs located between the grooves.

2. The projectile-forming charge as claimed in claim 1, wherein said grooves are uniformly symmetrically distributed along the inside of the annular portion.

* * * * *